US007252119B2

(12) United States Patent
Heatley

(10) Patent No.: US 7,252,119 B2
(45) Date of Patent: Aug. 7, 2007

(54) PAINT FILLING SYSTEM AND SAFETY DEVICE FOR PREPARING A PRESSURIZED CONTAINER OF PIGMENTED PAINT

(75) Inventor: Christopher Heatley, McHenry, IL (US)

(73) Assignee: Seymour of Sycamore, Sycamore, IL (US)

( * ) Notice: Subject to any disclaimer, the term of this patent is extended or adjusted under 35 U.S.C. 154(b) by 103 days.

(21) Appl. No.: 11/032,525

(22) Filed: Jan. 10, 2005

(65) Prior Publication Data

US 2006/0151050 A1 Jul. 13, 2006

(51) Int. Cl.
*B65B 1/04* (2006.01)

(52) U.S. Cl. ..... 141/20; 141/27; 141/95; 141/97; 141/360

(58) Field of Classification Search ..... 141/2, 141/18, 20, 27, 95, 97, 198, 350, 360, 372
See application file for complete search history.

(56) References Cited

U.S. PATENT DOCUMENTS 3,335,765 A 8/1967 Moonan
3,338,022 A 8/1967 Moonan et al.
3,604,477 A 9/1971 Grothoff
3,620,266 A 11/1971 Ryder
4,938,260 A 7/1990 Hirz
D361,581 S 8/1995 Hirz
5,535,790 A 7/1996 Hirz
5,647,408 A 7/1997 Erste et al.
5,740,841 A 4/1998 Hirz
5,832,965 A * 11/1998 Fasse et al. ..... 141/20
D424,662 S 5/2000 Gieske
6,077,898 A 6/2000 Flores
6,135,165 A 10/2000 Zanellato et al.
6,138,720 A 10/2000 Zeigler
6,302,163 B1 10/2001 Zeigler
6,705,359 B1 3/2004 Zanellato et al.

OTHER PUBLICATIONS

International Search Report for PCT/US2006/000516, Internationally filed Jun. 1, 2006.

* cited by examiner

*Primary Examiner*—Timothy L. Maust
(74) *Attorney, Agent, or Firm*—McDonnell, Boehnen, Hulbert, and Berghoff LLP

(57) ABSTRACT

An apparatus for charging pressurized aerosol cans with liquid is provided having a reservoir, filler coupling and safety release device. The safety release device automatically prevents over-charging the can by interacting with the safety dome to cause the can to disengage from the filling reservoir.

4 Claims, 2 Drawing Sheets

PAINT FILLING SYSTEM AND SAFETY DEVICE FOR PREPARING A PRESSURIZED CONTAINER OF PIGMENTED PAINT

BACKGROUND OF THE INVENTION

My invention relates to a device and system to allow for the preparation of a pressurized container of paint formulation of a desired color and gloss at the point of retail sale to the ultimate end user. Specifically, my invention relates to a system for injecting a paint composition into pressurized containers, and, more particularly, to an improved filling system for filling aerosol cans that uses a safety release device that prevents over charging, damage to the pressurized container and injury to the user.

One of the most significant developments in the field of paints and other protective coatings is the introduction and development of aerosolized coatings, most commonly referred to as "spray paint." Retail stores have shelf upon shelf of these pre-filled pressurized containers of complete paint and coatings formulations, in every imaginable color and gloss that are "ready to use". These complete, pre-packaged spray paint containers provide the customer with a convenient means to purchase small quantities of paint in a readily useable spray container for easy application. Unfortunately, in situations where the end user has a particular color in mind or wants to match a particular existing color, the current art of spray paint forces the end user to select a paint color that in most cases is not the exact color that the user desires. This is because there is no convenient means to allow a consumer to select a color and have that exact color made at the point of purchase. Instead, the user must search a myriad of brands of spray paint in the hope of finding a color that at least comes close to the desired color. Often times, this causes the end user to travel from store to store in search of such a match. Another drawback of the conventional spray paint product is that the inability to prepare a final paint color at the point of sale directly affects the retailer. Because conventional spray paint is only available from the manufacturer in pre-selected and predetermined colors and gloss, the retailer is forced to stock and carry inventory for a large number of cans to accommodate a large number of colors and gloss finishes. This further requires the use of an inordinate amount of shelf space in the store, thus limiting the amount of other products that can be displayed.

A convenient solution to the above mentioned problems would be to allow the retail outlet at the point of sale to formulate the final color of the spray paint based on the end user's selections of color and gloss at the moment of sale. In this way only a very limited number of spray containers containing either a clear or neutral base paint formulation need to be stocked and shelved by the retailer. The end user can then select a final paint formulation that exactly matches his or her needs. Of course, once the final color is selected, there exists the problem of injecting the final paint formulation into the can. In a manufacturing setting large, non-portable paint filling machines are routinely used to inject paint formulations into pre-pressurized containers. However, at the retail level, such machines are non-existent or very rare. Existing paint filling machines are presently available as large bench mounted machines that are pneumatically operated to inject paint and the like into pre-charged aerosol cans. Some examples of these machines are described in U.S. Pat. Nos. 6,302,163 and 6,138,720 and in the references cited in those two patents. Such machines commonly include a large manually operated lever that is connected to a piston assembly that pneumatically injects a paint formulation from a reservoir through the aerosol valve and into the can. One drawback of this existing machine is the ease to which an untrained operator can over-pressure (or over charge) the container causing a potentially dangerous situation if the can were to rupture. Likewise, U.S. Pat. Nos. 5,740,841; 5,647,408, Des. 361,581; 4,938,260, and 5,535,790; each describe various filing machine designs that can inject a complete "custom" paint formulation into a pressurized can. Despite the improvements the art has seen in the design of paint filling machines, the art has not concerned itself with size or portability, but instead has been directed towards automated filling devices and the prevention of emissions of volatile organic compounds or VOC's to satisfy government regulations.

Although my earlier issued U.S. Pat. Nos. 6,705,359 and 6,135,165 describe a pressurized container containing certain paint additives which is eventually filled with a final water-borne paint composition of a selected color at the point of sale, those patents do not describe in detail any particular type of paint filling system that can be easily used at the point of sale location. My invention on the other hand provides a new and improved portable and compact aerosol can filling apparatus that includes a safety release device to prevent over charging the container, which overcomes the above referenced drawbacks of the prior art.

SUMMARY OF THE INVENTION

My invention includes a filling device with a safety release and also a system for injecting paint formulations and the like materials into a pre-pressurized container or can at a point of sale at the retail level. The filling device of my invention comprises, in combination, a housing that holds a reservoir and piston assembly, where the reservoir is designed to hold the paint formulation to be injected into the pressurized container. The piston assembly includes a shaft and piston either directly or indirectly attached to a handle and operatively associated with the reservoir such that by squeezing the handle the piston moves forcing the paint formulation from the reservoir through a filler coupling connected to the reservoir and into the container. The filling device also has a safety release connected to the housing that is designed to engage the container during filling and to automatically break the connection between the filler coupling and container if the container becomes over pressurized.

The safety release device of my invention comprises, in combination, a tubular shell having a first end and a second end, where the first end has an attachment means to allow it to be screwed onto the housing of the paint filling device. The second end has a can stop surface that engages a lip on a spray paint can when the can is attached to the safety device. The second end also contains a plurality of dome engaging surfaces located circumferentially inside the second end that rest upon the safety dome of an attached can.

The advantages of my invention include safety, portability, compactness, and affordability. A most important advantage is that the safety release device automatically disengages the can from the reservoir if over charging occurs. When such a situation occurs the safety dome of the can expands outwardly pushing against the dome engaging surfaces of the safety release device causing the can to be pushed away or slightly ejected from the safety release device a distance sufficient to break the seal between the filler coupling and the can valve opening. Breaking this seal will prevent the can from being over-pressurized and ruptured.

Still further advantages of the present invention will become apparent upon reading and understanding the following detailed description of preferred embodiments. The invention also may take form in various parts and arrangement of parts. The accompanying drawings are only for purposes of illustrating preferred embodiments and are not to be construed as limiting the invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

Figure 1:
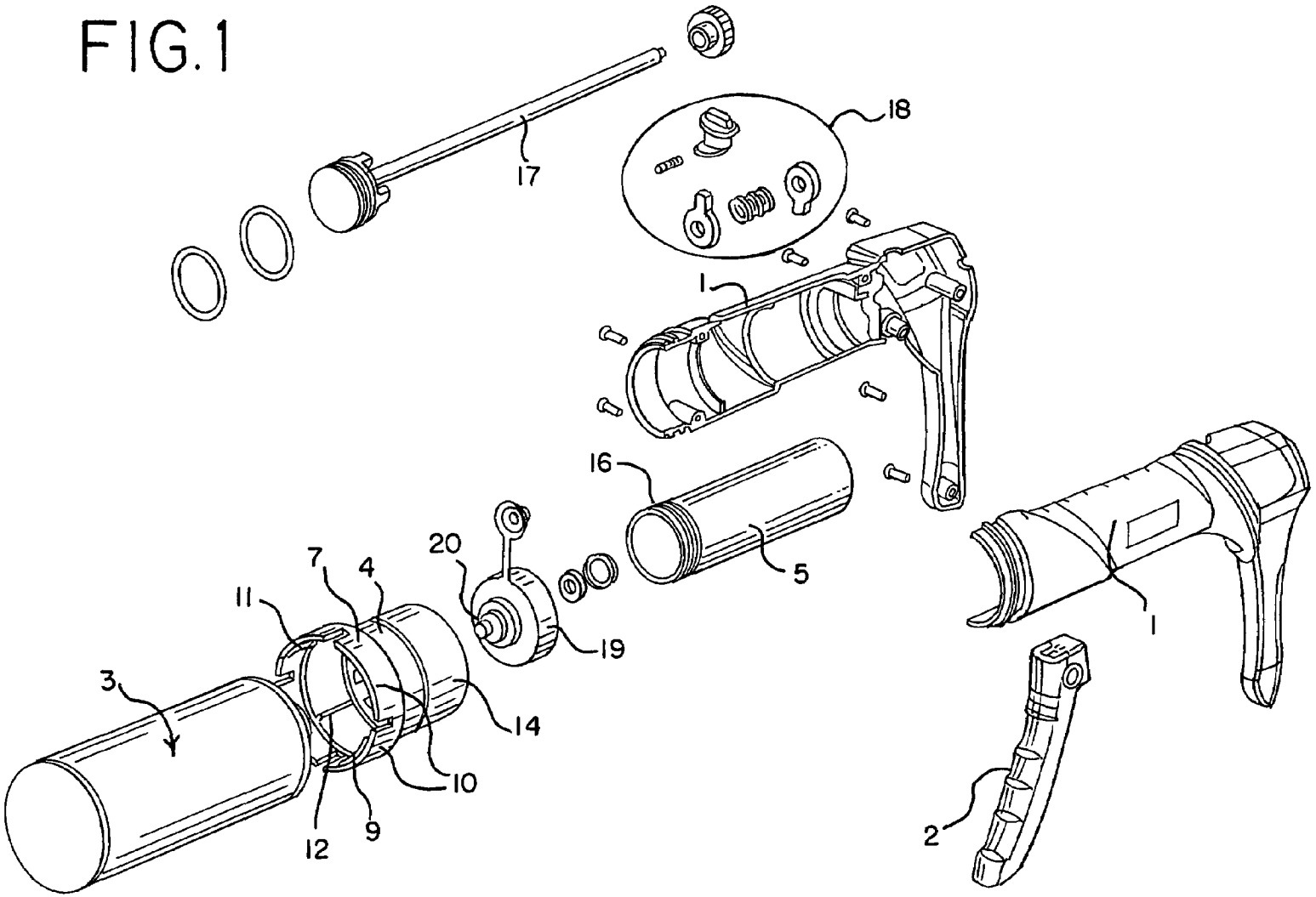
FIG. 1 is an exploded view of an aerosol can-filling system in accordance with the present invention.
Figure 2:
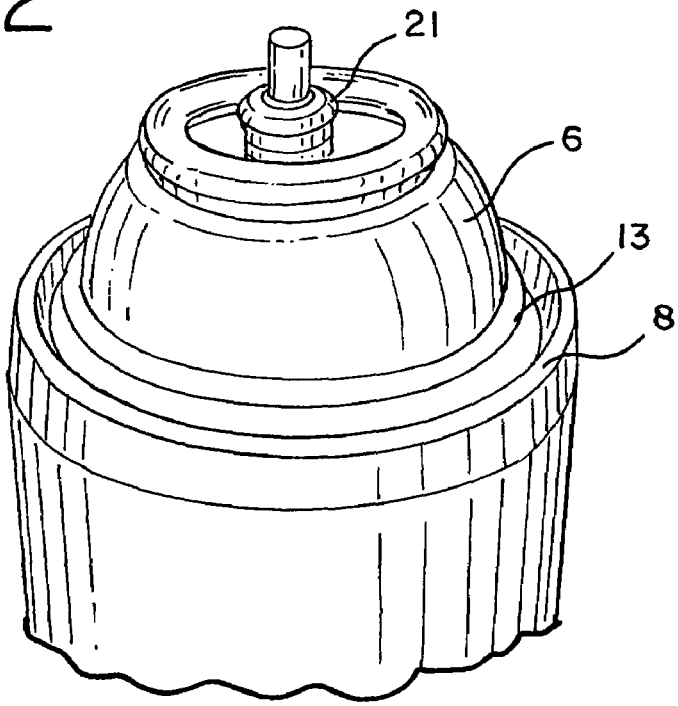
FIG. 2 is a perspective view of the top of a conventional aerosol container to be used in conjunction with my invention.
Figure 3:
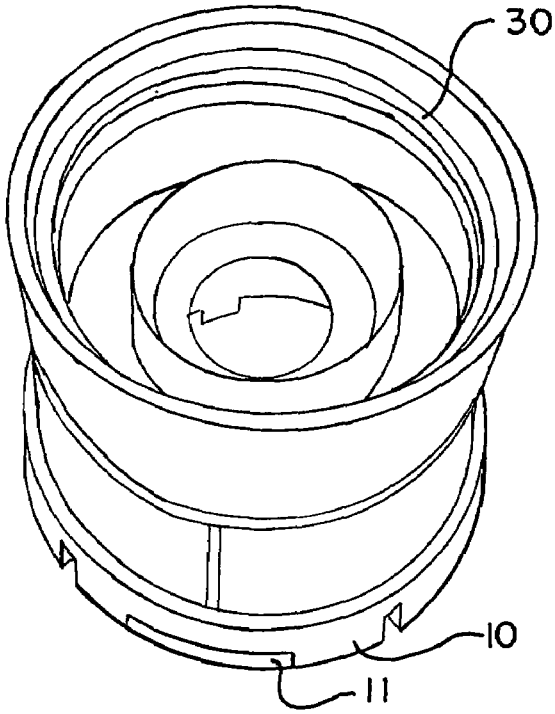
FIG. 3 is a perspective view of the first end of the safety device of the invention.

Referring now to FIG. 1, which shows an exploded view of the filing device of my invention, a conventional aerosol can 3 and associated safety release device 4. FIG. 2 shows the details of the top half of a conventional aerosol can. The specific size of the aerosol can is not an important feature of my invention as any conventional aerosol can will work, provided that the can has a safety dome 6 as depicted by the perspective view of the top half of can 3 in FIG. 2. FIG. 2 depicts a conventional can with a male valve 21, however, female valves are also used in the art and will work with my invention. Regardless of the valve type, the safety dome found on conventional aerosol cans is characterized by its ability to expand outwardly when the can is subjected to an over-pressure situation. In operation of the filling device, can 3 engages a second end 7 of safety device 4 until can lip 8 comes into bearing contact with can stop surface 9. Can stop surface 9 prohibits over-insertion of the can into the second end of the safety device indicating to the user that the safety device is properly positioned on the can prior to filling and that valve coupling 20 is in pressure seal with can valve 21. Valve coupling 20 will vary in design depending on whether a female or male valve is present. Second end 7 can also have a plurality of flexible can engaging tabs 10 that have can gripping projections 11 located on the internal surfaces of the flexible engaging tabs. These gripping projections provide bearing surfaces that releasably hold the can to the safety device in a secure and even manner during filling. Second end can 7 also contain a plurality of dome engaging surfaces 12 located circumferentially inside the second end.

When the can is fully inserted in safety device 4, dome engaging surfaces 12 are positioned adjacent to dome indent 13. In an over pressure situation dome indent 13 expands outwardly and pushes against dome engaging surfaces 12 causing can 3 to push outwardly and away from safety device 4 a distance that is sufficient to break the connection between valve 21 and coupling 20, as described below, i.e., between the can and the filling device of my invention.

Safety device 4 also has a first end 14 that contains an attachment means to securely connect safety device 4 to housing 1. Although any secure means of attachment will work, a preferred attachment means are internal threads 30 as shown in FIG. 2. These internal threads 30 are designed to engage external threads 15 on housing 1 so as to securely attach safety device 4 to housing 1. Housing 1 contains handle 2 that is operatively connected to piston and shaft 17 that is located partially within reservoir 5. When handle 2 is squeezed, a system of connectors 18 causes piston and shaft 17 to move within reservoir 5. Reservoir 5 has a filler coupling 19 that can be securely fastened to reservoir 5 through external threads 16. Filler 19 contains coupling insert 20 which is designed to create a pressure seal with can valve 21 to allow transfer of the contents of reservoir 5 into can 3. Movement of the pressured contents in reservoir 5 from the reservoir through filler coupling 19 and coupling 20 opens the can valve 21 allowing the pressured contents to flow into can 3. When operating the filling device of my invention, a paint formulation is first placed within reservoir 5 and then filler coupling 19 is secured to the reservoir. Safety device 4 is then secured to housing 1. Can 3 is then inserted into the second end 7 of safety device 4 until can lip 8 engages can stop surface 9 and valve coupling 20 makes a pressure seal connection with can valve 21.

With can 3 properly positioned in safety device 4, the user squeezes handle 2 is squeezed causing piston and shaft 17 to move within reservoir 5 towards can 3 and away from handle 2. This action pressurizes the paint formulation within reservoir 5 until it becomes greater than the starting pressure of the pre-filled can 3 and opens valve 21. At this point further squeezing of handle 2 causes the paint formulation to be injected into can 3. Handle 2 is operated until the desired amount of the paint formulation is transferred from reservoir 5 to can 3. If for some reason can 3 becomes over-pressurized, safety dome indent 13 will expand outwardly making bearing contact with dome engaging surfaces 12. Because safety device 4 is securely attached to housing 1, the pressure exerted by the expanding dome indent 13 causes can 3 to move away from safety device 4 thus breaking the pressure seal between can valve 21 and valve coupling 20 on filler coupling 19. Once the seal is broken, any further action of handle 2 will not result in further pressuring or filling of can 3 because the pressure seal is broken and there will be no fluid connection between reservoir 5 and can 3. With this automatic release design it is impossible to over-pressure a can to the point of rupture because at the first instance of over-pressurizing the can will be forced away from the filling device and the filling connection between the can and the reservoir will be broken.

The invention has been described with reference to a preferred embodiment. Obviously, modifications and alterations will occur to others upon reading and understanding the preceding specification. It is intended that the invention be construed as including all such alterations and modifications insofar as they come within the scope of the appended claims or the equivalents thereof.

I claim:

1. A system for safely filling a container with a paint formulation comprising, in combination, e. a container with a domed top and a safety indent;

f. a housing;

g. a reservoir operatively located within the housing;

h. a piston and shaft operatively and removably associated with the reservoir;

i. a handle operatively connected to the shaft;

j. a filler coupling connected to the reservoir and in fluid communication with the container; and k. a safety release connected to the housing and engaging the domed top whereby a spatial change in the safety indent will cause the container to disengage from the safety release and the filler coupling.

2. The system of claim 1 whereby the piston, handle, shaft and reservoir are configured to allow a user to hold the system in hand while injecting a paint formulation into the container under pressure.

3. A filling device for safely injecting paint formulations into a pressurized container comprising, in combination, a. a housing b. a reservoir operatively located within the housing;

c. a piston and shaft operatively and removably associated with the reservoir;

d. a handle operatively connected to the shaft;

e. a filler coupling connected to the reservoir; and f. a safety release connected to the housing, wherein the safety release is adapted to releasably receive and connect to a partially filled and pre-pressurized container and to automatically release the container from the safety release in an over pressure condition, where the piston, handle, shaft and reservoir are configured to allow a user to hold the system in hand while injecting a paint formulation into the container under pressure.

4. A filling device for safely injecting paint formulations into a pressurized container comprising, in combination, a. a housing b. a reservoir operatively located within the housing;

c. a piston and shaft operatively and removably associated with the reservoir;

d. a handle operatively connected to the shaft;

e. a filler coupling connected to the reservoir; and f. a safety release connected to the housing, wherein the safety release is adapted to receive and connect to a pre-pressurized container and to automatically release from the housing when the container becomes over pressurized, where the piston, handle, shaft and reservoir are configured to allow a user to hold the system in hand while injecting a paint formulation into the container under pressure.

* * * * *